US012698691B2

(12) United States Patent
Smith

(10) Patent No.: US 12,698,691 B2
(45) Date of Patent: Aug. 4, 2026

(54) WIRELINE DERRICK, SYSTEM, AND PROCESS

(71) Applicant: Jerred Smith, Wichita Falls, TX (US)

(72) Inventor: Jerred Smith, Wichita Falls, TX (US)

( * ) Notice: Subject to any disclaimer, the term of this patent is extended or adjusted under 35 U.S.C. 154(b) by 0 days.

(21) Appl. No.: 18/916,003

(22) Filed: Oct. 15, 2024

(65) Prior Publication Data

US 2025/0122776 A1 Apr. 17, 2025

Related U.S. Application Data

(60) Provisional application No. 63/544,267, filed on Oct. 16, 2023.

(51) Int. Cl.
*E21B 33/072* (2006.01)
*E21B 15/00* (2006.01)
*E21B 19/00* (2006.01)

(52) U.S. Cl.
CPC ..... *E21B 33/072* (2013.01); *E21B 15/00* (2013.01); *E21B 19/008* (2013.01)

(58) Field of Classification Search
CPC ..... E21B 33/072; E21B 15/00; E21B 19/008; E21B 19/22
See application file for complete search history.

(56) References Cited

U.S. PATENT DOCUMENTS 4,036,508 A 7/1977 Eddy et al.
4,290,495 A * 9/1981 Elliston ..... E21B 19/084 173/147
4,932,175 A 6/1990 Donnally
5,161,639 A 11/1992 Ice
6,305,471 B1 10/2001 Milloy
2016/0312543 A1 10/2016 Cheng et al.
2017/0186512 A1 6/2017 McFarland et al.
2018/0216413 A1* 8/2018 Fossheim ..... E21B 15/00
2020/0199976 A1* 6/2020 Stahl ..... E21B 19/008

OTHER PUBLICATIONS

Shane Thomas, International Search Report, Feb. 5, 2025, USA.
Shane Thomas, Written Opinion of the International Searching Authority, Feb. 5, 2025, USA.

* cited by examiner

*Primary Examiner* — Nicole Coy
*Assistant Examiner* — Nicholas D Wlodarski
(74) *Attorney, Agent, or Firm* — Brian K. Yost; Kiala E. Ellingson; Decker Jones, PC

(57) ABSTRACT

A wireline derrick has a telescopically arranged frame, a sheave, a winch, and pressure control equipment. Pressure control equipment (PCE) is positioned within the frame. An upper section of the derrick can extend and retract relative to a lower section. When the wireline derrick is in the retracted position, an upper PCE assembly is positioned adjacent to the lower PCE assembly. The upper PCE assembly is laterally moveable, such that when the wireline derrick is in the extended position, the upper PCE assembly may be moved into and out of axial alignment with the lower PCE assembly. When in a fully deployed condition, the lower end of the upper PCE assembly is removably coupled to the upper end of the lower PCE assembly. A transport trailer is adapted to move the wireline derrick from a horizontal position to a vertical position and cause the upper section to extend and retract.

20 Claims, 9 Drawing Sheets

WIRELINE DERRICK, SYSTEM, AND PROCESS

This application claims the benefit of U.S. Provisional Application No. 63/544,267 filed Oct. 16, 2023, the contents of which are incorporated herein in their entirety.

BACKGROUND OF THE INVENTION

1. Field of the Invention

The present invention relates generally to wireline systems and specifically to a wireline derrick, system, and process comprising a transportable and telescopically deployable wireline derrick that permits wireline operations to be economically and safely performed.

2. Description of the Prior Art

Oil and gas wireline services are used in the exploration, evaluation, and production of oil and natural gas wells. Wireline service operations involve using a winch attached to a specialized cable, known as a wireline, to lower various tools and instruments into a wellbore to perform a range of tasks. Wireline services can be used to assess the geological formations encountered during drilling. Wireline tools such as logging instruments are used to measure properties like rock formation composition, porosity, permeability, and fluid content. Other tools are used to collect samples. This data helps geologists and engineers determine the potential for hydrocarbon production and understand the subsurface characteristics of the reservoir. Wireline services are also used to assess the integrity of the well casing and identify any potential leaks or issues that could affect well performance and safety. Wireline operations can also include interventions, such as cleaning out debris or obstructions in the well or installing specialized equipment like downhole pumps or gauges.

Referring to FIG. 4, in prior art conventional wireline systems, the wireline extends from a wireline drum mounted on a wireline truck, along the well site surface, around a lower sheave positioned at the wellhead, upward and over an upper sheave, and through a number of above surface components such as lubricators, connectors, and pressure control equipment (PCE) (collectively referred to herein as a PCE string). A crane is used to lift and move the PCE string to a desired position, such as, for example, toward or away from the wellhead. Conventionally, the crane's cable is attached to a "lifting tool" which in turn supports the upper sheave and PCE string. The lifting tool comprises a spreader bar, rope slings, and one or more lifting clamps. The upper sheave is positioned immediately below the spreader bar and between the rope slings. The lifting clamp is attached to a portion of the PCE string at a desired position on the PCE string, such as below the lubricator. The wireline extends from the lower end of the PCE and is attached to a bottom hole assembly (BHA) comprising the downhole tools needed for the downhole wireline operation.

Conventional wireline systems and operations require the use of both a crane and a wireline truck. The crane, wireline truck, and labor at the wellsite are used to assemble the PCE string and other components making up the wireline system. The machines, vehicles, components, and labor necessary to assemble, operate, and disassemble a conventional wireline system may be spread out over a significant portion of the wellsite for extended periods of time. Thus, conventional wireline systems are time consuming to assemble, operate, and disassemble at the wellsite.

What is needed is a wireline structure and system that can be deployed, used, and disengaged quickly, efficiently, and safely.

SUMMARY OF THE INVENTION

The present disclosure provides a wireline derrick and system that can be deployed, used, and disengaged quickly, efficiently, and safely. The following is a general description of the wireline derrick, system, and process of preferred embodiments.

The wireline derrick of preferred embodiments is transported to and from a wellsite on a specially configured transport trailer. After removal of the wireline derrick from the transport trailer, the wireline derrick may be positioned directly above a wellhead. The wireline derrick's pressure control equipment is removably coupled to a wellhead hydraulic latch assembly.

The wireline derrick generally comprises a lower section and an upper section. Attached to the rear of the lower section is a winch assembly comprising a casing containing a drum around which a wireline is spooled. The lower and upper sections are trussed towers comprising a plurality of vertical, horizontal and diagonal reinforcement members.

In preferred embodiments, the lower and upper sections are slidingly and telescopically arranged such that the one section can, at least partially, nest within the other. In some embodiments the upper section nests, at least partially within the cavity of the lower section. In other embodiments the lower section nests, at least partially within the cavity of the upper section. Movement of hydraulic cylinders selectively extends and retracts the upper section with respect to the lower section.

At or near a position where the upper and lower sections overlap are one or more through openings through which hydraulically controlled locking pin arrangements may be selectively extended and retracted to secure the upper and lower sections in a desired position with respect to one another.

An upper end of the upper section comprises a lifting assembly comprising lift plates adapted to receive a lifting sling. The lifting sling is structured to be connected to a hook of a crane. Attached at or near the lifting assembly is a sheave.

The wireline derrick contains a pressure control equipment string comprising a lower PCE assembly and an upper PCE assembly. The upper and lower PCE assemblies can be removably coupled together when the wireline derrick is a fully deployed position.

The upper PCE assembly is movable from a transport position to an axially aligned position. In the transport position, the upper PCE assembly is positioned off-center relative to the upper section. Thus, in such transport position, the upper PCE assembly does not interfere with or otherwise come in contact with the lower PCE assembly. This arrangement permits the upper and lower PCE assemblies to be positioned side by side when the upper section has not been extended from the lower section such as when, for example, the wireline derrick is in the horizontal position, transport position.

When the upper PCE assembly is in the axially aligned position, the upper PCE assembly is axially aligned with the lower PCE assembly. From the axially aligned position, the upper PCE assembly can be lowered and coupled to the lower PCE assembly. In preferred embodiments, after being positioned in the axially aligned position, the upper PCE assembly is lowered by lowering the upper section as described herein. When the upper PCE assembly is coupled to the lower PCE assembly, and the upper and lower sections are secured in position as described herein, the wireline derrick is in the fully deployed position. Movement of the hydraulic cylinders selectively moves the upper PCE assembly from and between the transport position to the axially aligned position.

In preferred embodiments, the wireline derrick is adapted to be enclosed for winter time operations. This arrangement prevents surface equipment and the wellbore from freezing up.

The transport trailer is structured to move the wireline derrick from the transport position to an upright position. Similarly, the transport trailer is also structured to move the wireline derrick from the upright position to the transport position.

In some embodiments, the transport trailer comprises selectively deployable and retractable stabilizers such as outriggers and/or jack stabilizers. The stabilizers may be part of a commercially available auto-leveling system. In addition to the stabilizers the auto-leveling system comprises sensors, software, programming, and other elements adapted to deploy and retract the stabilizers and maintain the transport trailer in a desired, preferably, level, position.

In preferred embodiments, the transport trailer comprises two forward entry points. In such embodiments, the forward entry points comprise steps.

Support assemblies are pivotally and removably coupled with the lower section via respective support receivers which are each adapted to receive respective lower section insertion members. Each pair of upwardly projecting parallel plates and respective lower section insertion members comprise a through opening through which a pin can be inserted in a manner well known in the art. This coupling arrangement between the parallel plates and the respective lower section insertion members permits the wireline derrick to pivot, using the pin as a fulcrum/pivot point, so that the wireline derrick can be moved from the transport position to the upright position.

The wireline derrick is moved from the transport position to the upright position using respective transport trailer hydraulic cylinders. The transport trailer hydraulic cylinders are operatively connected to a hydraulic powerpack unit (HPU) in an operation control unit.

In preferred embodiments, prior to rotating the wireline derrick a properly sized crane is connected to the wireline derrick to follow the wireline derrick as it is moved between various positions. This arrangement creates added safety to the operation. In preferred embodiments, the upper section is extended from the lower section while attached to the transport trailer. Once in the upright position, the lower and upper sections are arranged and secured such that the upper PCE assembly is shifted into axial alignment with the lower PCE assembly and the two PCE assemblies are coupled together. After the two PCE assemblies are secured and the pins are removed from the respective through openings in the support receivers and lower section insertion members, the crane can remove the wireline derrick from the transport trailer. After removing the wireline derrick from the transport trailer, the crane can then move the wireline derrick to a desired position, such as at the wellhead or near the operation control unit.

The system of preferred embodiments is structured and arranged such that substantially all the wireline components are operated and controlled in the operation control unit. The operation control unit comprises a climate controlled forward mechanical section and rearward section. The forward mechanical section comprises the HPU, electric controls, and a plurality of hydraulic operated reels. The HPU is a hydraulic power unit used to control all hydraulic functions for two wireline derricks. Similarly, the electric controls are used to control all electrical functions for two wireline derricks. A first hydraulic operated reel is structured to be used to control the transport trailer functions discussed herein, including, but not limited to moving the wireline derrick from and between the extended and retracted positions, extending and retracting the upper section from/into the lower section. A second hydraulic operated reel is structured to be used to control PCE string functions. A third hydraulic operated reel is used to control an umbilical cord to each structure that permits an operator to communicate with the wireline during wireline operations.

The rearward section of the preferred embodiment comprises dual winch control work stations. This arrangements permits two operators to simultaneously control winch operations of two wireline derricks. The operation control unit is further structured and adapted to permit operators to monitor and control various operation parameters. For example, the operation control unit is communicatively and operationally linked to inspection equipment for monitoring wireline OD during operations; view the wireline derrick using cameras and LED lighting connected to or adjacent to the wireline derrick.

Many automated functions can be monitored and controlled from the operation control unit. For example, operators can monitor and/or control: a BOP open/close process; a tool trap open/close process; auto-adjustment of the wireline as the wireline derrick extends or retracts; a quick test for the upper HLA after coupling; a pressure/time recording for the HLA quick test; etc.

Communication to and from the wireline derrick can be initiated, monitored, and controlled from the operation control unit. Each wireline derrick receives directions and communication from the operation control unit. Electric power for and to the wireline drum is controlled and directed from the operation control unit. The operation control unit is structured and set up to control and host communications between the various systems and subsystems used in wireline operations, including, but not limited to those related to depth & tension monitoring; communication with the BHA; hydraulic power for pressure control; operation of the BOP's, tool trap, HLA's, pack-off pressure, cameras and sensors; measuring head and BHA weight with indicator attached to drum; slip ring communication off drum; and wireline oiling system.

The operation control unit of preferred embodiments is a mobile structure adapted to be transported to the wellsite by a suitable towing vehicle. The operation control unit need not be mobile. In other embodiments, the operation control unit is a permanent structure. arrangement having axle and wheel assemblies and other conventional parts that permit the operation control unit to be easily transported to and from the wellsite.

Also provided and disclosed herein is a wireline system. The wireline system of preferred embodiments comprises the wireline derrick, the transport trailer, and the operation control unit.

Also provided and disclosed herein is a process for deploying a wireline derrick. The process of preferred embodiments comprises the steps of:

1.) providing a wireline derrick, the wireline derrick comprising: (a) a telescopically arranged lower section and upper section; (b) a winch assembly; (c) a pressure control equipment string (PCE string) comprising a lower PCE assembly and an upper PCE assembly;

2.) providing a transport trailer;

3.) Using the transport trailer, moving the wireline derrick from a transport position to an upright position;

4.) Using the transport trailer, extending the upper section from the lower section;

5.) Moving the upper PCE assembly into axial alignment with the lower PCE assembly;

6.) Coupling the upper PCE assembly with the lower PCE assembly;

7.) Securing the upper section to the lower section.

In other embodiments of the process for assembling a wireline derrick, the wireline derrick is moved by a crane from a position proximate to the transport trailer to a position away from the transport trailer such as at the wellhead or a position proximate to an operation control unit.

Also provided and disclosed herein is a process for removing from deployment (hereafter "disengaging") a wireline derrick. The process of preferred embodiments comprises the steps of:

1.) providing a wireline derrick in a deployed condition, the wireline derrick comprising: (a) a telescopically arranged lower section and upper section; (b) a winch assembly; (c) a pressure control equipment string (PCE string) comprising a lower PCE assembly and an upper PCE assembly; the lower section being secured to the upper section; the lower PCE assembly being coupled to the upper PCE assembly;

2.) providing a transport trailer;

3.) disengaging the upper section from the lower section;

4.) decoupling the upper PCE assembly from the lower PCE assembly;

5.) Moving the upper PCE assembly out of axial alignment with the lower PCE assembly;

5.) Using the transport trailer, retracting the upper section into the lower section;

6.) Using the transport trailer, moving the wireline derrick from an upright position to a transport position on the transport trailer.

In other embodiments of the process for disengaging a wireline derrick, the wireline derrick is moved by a crane from a position away from the transport trailer to a position proximate to the transport trailer.

DESCRIPTION OF THE PREFERRED EMBODIMENT

Referring to the figures, there is shown the wireline derrick 12 and system 10 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

Figures 1, 2, 3:
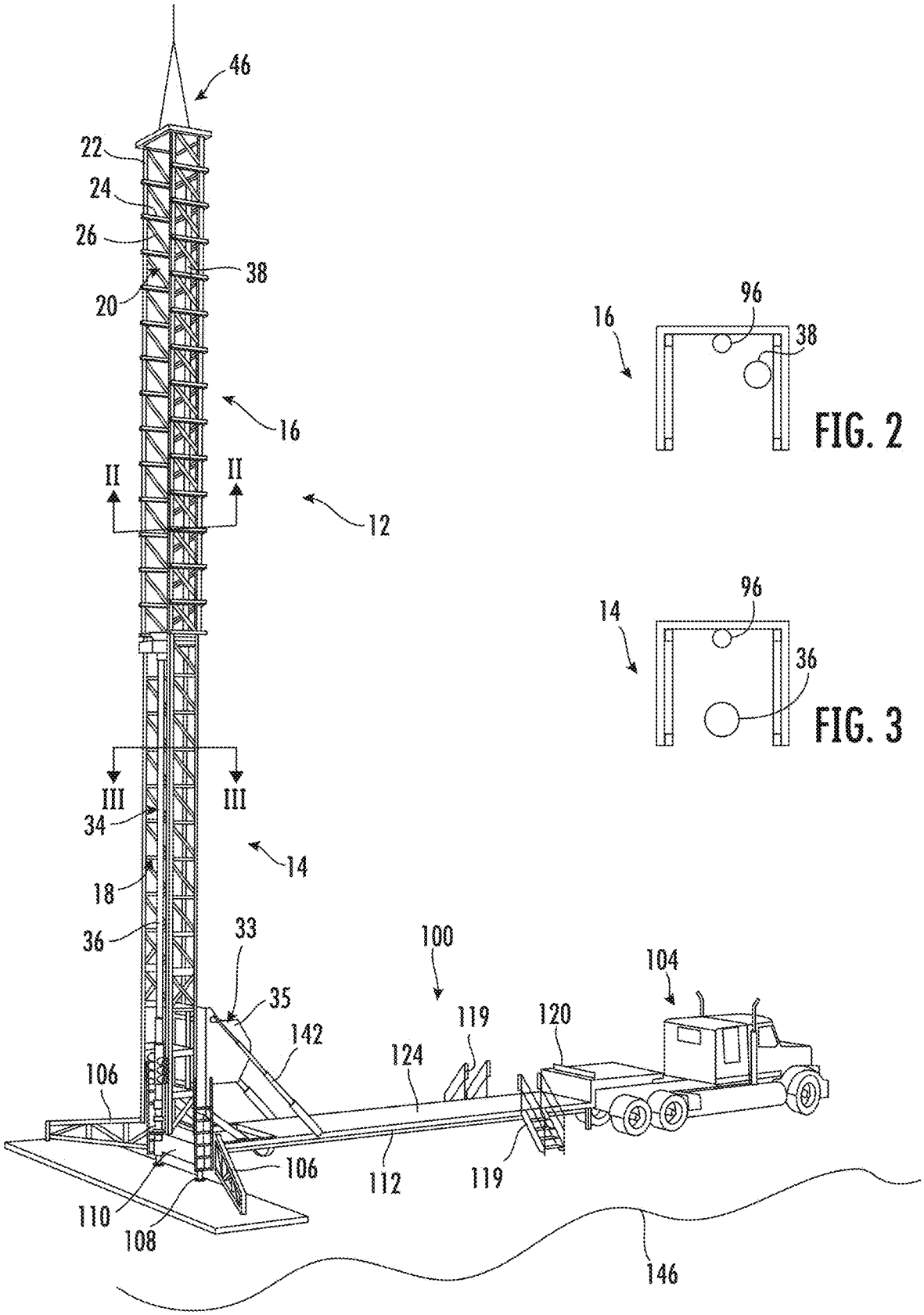
FIG. 1 is a left and front isometric view of the wireline derrick and isometric right and rear view of a transport trailer, the wireline derrick being connected to the transport trailer and being in a partially deployed condition, in accordance with a preferred embodiment.
FIG. 2 is a sectional view of section II-II of FIG. 1.
FIG. 3 is a sectional view of section III-III of FIG. 1.
Figure 4:
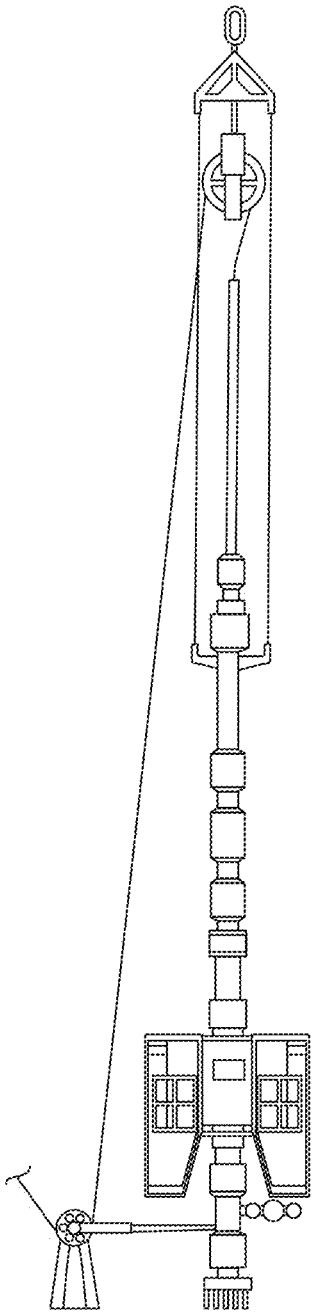
FIG. 4 PRIOR ART
FIG. 4 is a front elevation view of a prior art wireline system.
Figure 9:
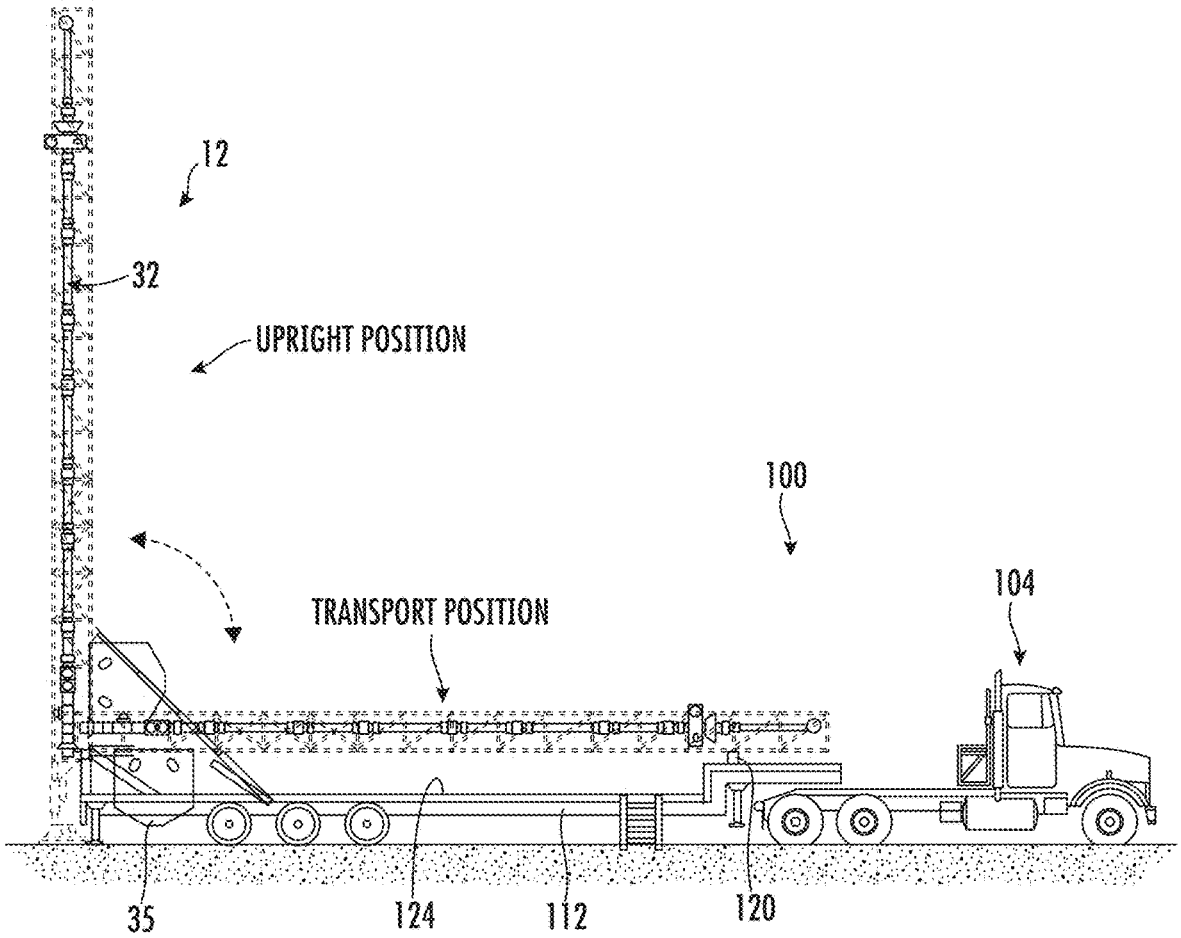
FIG. 9 is a conceptual side elevation view of the wireline derrick and transport trailer of FIG. 1 depicting the wireline derrick in both a transport position and an upright position.

The following is a general description of the wireline derrick 12, system 10, and process of preferred embodiments. Referring to FIGS. 1 and 9, the wireline derrick 12 of preferred embodiments is transported to and from a wellsite 146 on a specially configured transport trailer 100. After removal of the wireline derrick 12 from the transport trailer 100, the wireline derrick 12 may be positioned directly above a wellhead 130, the wellhead 130 being operationally connected to a wellbore 132 (the wellbore 132 being part of a well 118 at the wellsite 146, the wellsite 146 comprising a surface 144). As will be discussed in more detail below, in operation, the wireline derrick's 12 pressure control equipment 34 is removably coupled to a wellhead hydraulic latch assembly 134 (HLA 134). A more specific description of the wireline derrick 12 transport trailer 100 and other system 10 components will follow.

A. Wireline Derrick

The wireline derrick 12 of preferred embodiments generally comprises a lower section 14 and an upper section 16.

Figure 11:
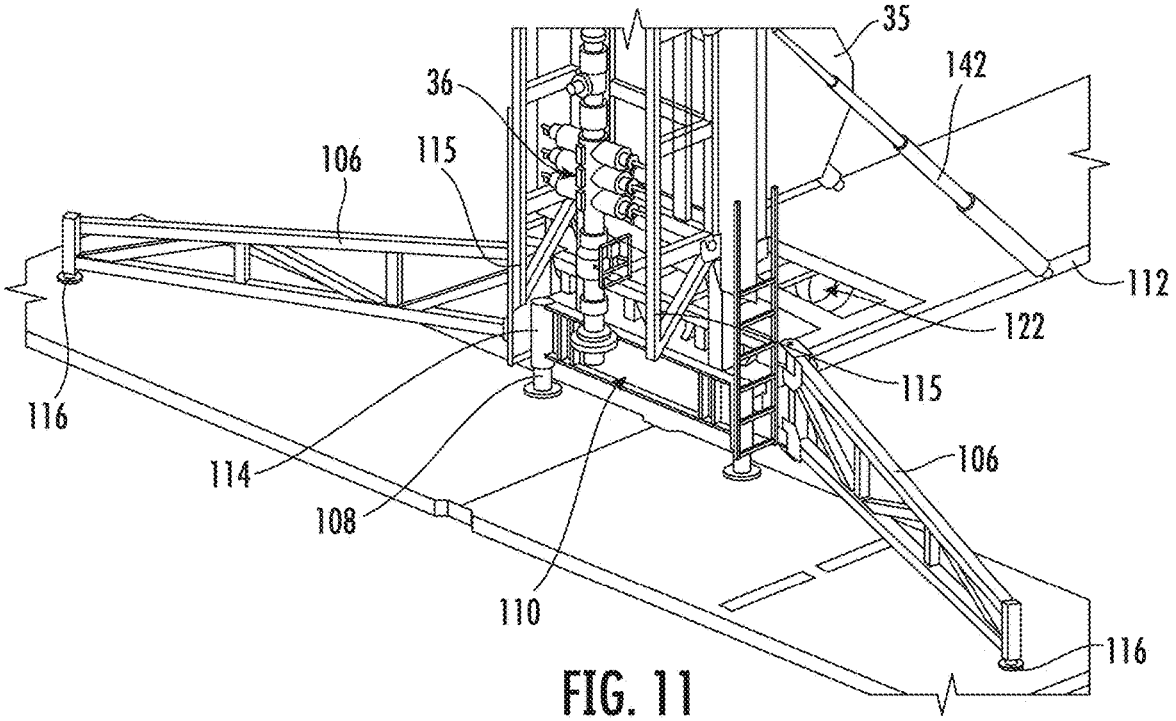
FIG. 11 is an enlarged view of a portion of FIG. 1, showing in more detail the lower portion of the wireline derrick connected to the rear of the transport trailer.

Attached to the rear of the lower section 14 is a winch 33 assembly comprising a casing 35 containing a drum 37 around which a wireline 40 is spooled. The lower and upper sections 14, 16 are trussed towers 18, 20 comprising a plurality of vertical, horizontal and diagonal reinforcement members 22, 24, 26. In preferred embodiments, the lower and upper sections 14, 16 are three sided such that the plurality of vertical, horizontal and diagonal reinforcement members 22, 24, 26 form respective sides 28 and rear 30 of the lower and upper sections 14, 16. The respective sides 28 and rear 30 of the lower and upper sections 14, 16 define respective cavities 32L and 32U. Referring to FIG. 11, a lowermost portion of the lower section 14 comprise alignment arms 115 adapted to rest in a flow-cross cradle.

In preferred embodiments, the lower and upper sections 14, 16 are slidingly and telescopically arranged such that the one section 14, 16 can, at least partially, nest within the other 14, 16. In some embodiments, the telescopic arrangement of the lower and upper sections 14, 16 and movement is conventional and commercially available. Persons skilled in the art will understand such structure. In some embodiments the upper section 16 nests, at least partially within the cavity 32L of the lower section 14. In other embodiments the lower section 14 nests, at least partially within the cavity 32U of the upper section 16. In preferred embodiments, the wireline derrick 12 comprises one or more conventional and commercially available hydraulic cylinders 96. The hydraulic cylinders 96 are operatively connected to a hydraulic fluid and pump adapted to selectively move the hydraulic cylinders 96 from and between an extended position to a retracted position. Movement of the hydraulic cylinders 96 selectively extends and retracts the upper section 16 with respect to the lower section 14.

At or near a position where the upper and lower sections 14, 16 overlap are one or more through openings 97 through which hydraulically controlled locking pin arrangements 99 known in the art may be selectively extended and retracted to secure the upper and lower sections 14, 16 in a desired position with respect to one another. The hydraulically controlled locking pin arrangements 99 of preferred embodiments are operatively connected to a conventional hydraulic fluid supply and pump.

Figure 5:
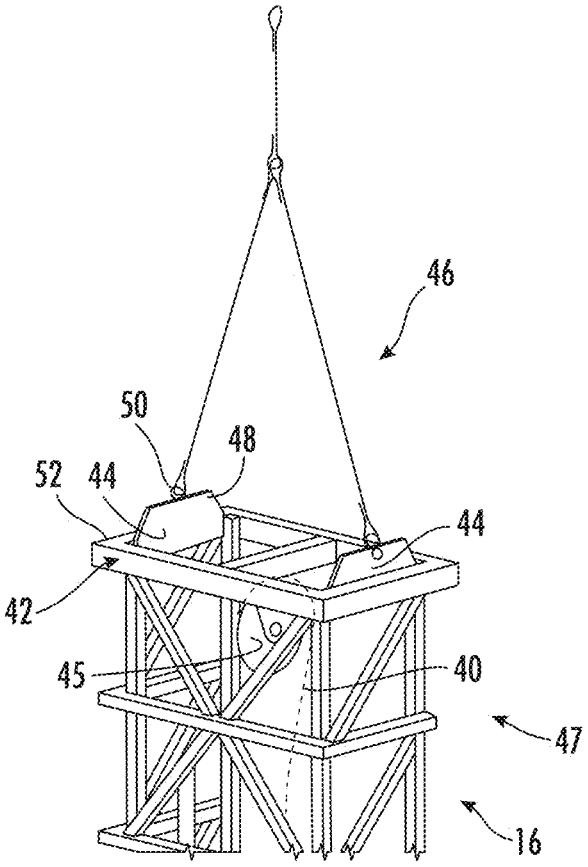
FIG. 5 is a right, top, and rear isometric view of an uppermost portion of the wireline derrick of FIG. 1.

Referring to FIG. 5, an upper end 47 of the upper section 16 comprises a lifting assembly 42 comprising lift plates 44 adapted to receive a lifting sling 46. In preferred embodiments, the lifting assembly 42 comprises a rectangular structure 52 that forms an uppermost end of the upper section 16. The lifting sling 46 is structured to be connected to a hook of a crane 49 attached to the crane's 49 wire rope. In preferred embodiments, the lift plates 44 are respective upwardly extending steel plates with one or more through openings 48 adapted to receive a link 50 or other conventional rigging hardware that permits cooperatively coupling of the lifting sling 46 to the lift plates 44. In the preferred embodiment, the lifting sling 46 is permanently attached to the lift plates 44 such that, for example, the lifting sling 46 does not need to be attached and detached to the lift sling 46 at the beginning and end of each operation. Attached at or near the lifting assembly 42 and centrally positioned below the lifting assembly is sheave 45 comprising a wheel around which a wireline 40 is suspended. The sheave 45 of preferred embodiments is permanently mounted to ensure alignment of the wireline 40 into a greaseless pack-off or grease head 58. The permanently mounted sheave 45 prohibits the sheave wheel to backspin in the event of wireline 40 torque.

In preferred embodiments, the wireline derrick 12 contains a pressure control equipment string 34 (PCE string 34). The PCE string 34 comprises a lower PCE assembly 36 and an upper PCE assembly 38. The lower PCE assembly 36 is positioned within the lower cavity 32L and attached to the lower section 14. The upper PCE assembly 38 is positioned within the upper cavity 32U and attached to the upper section 16. As will be discussed in more detail below, the lower and upper PCE assemblies 36, 38 are structured and arranged so as to be removably coupled together when the wireline derrick 12 is a fully deployed position.

Figure 6:
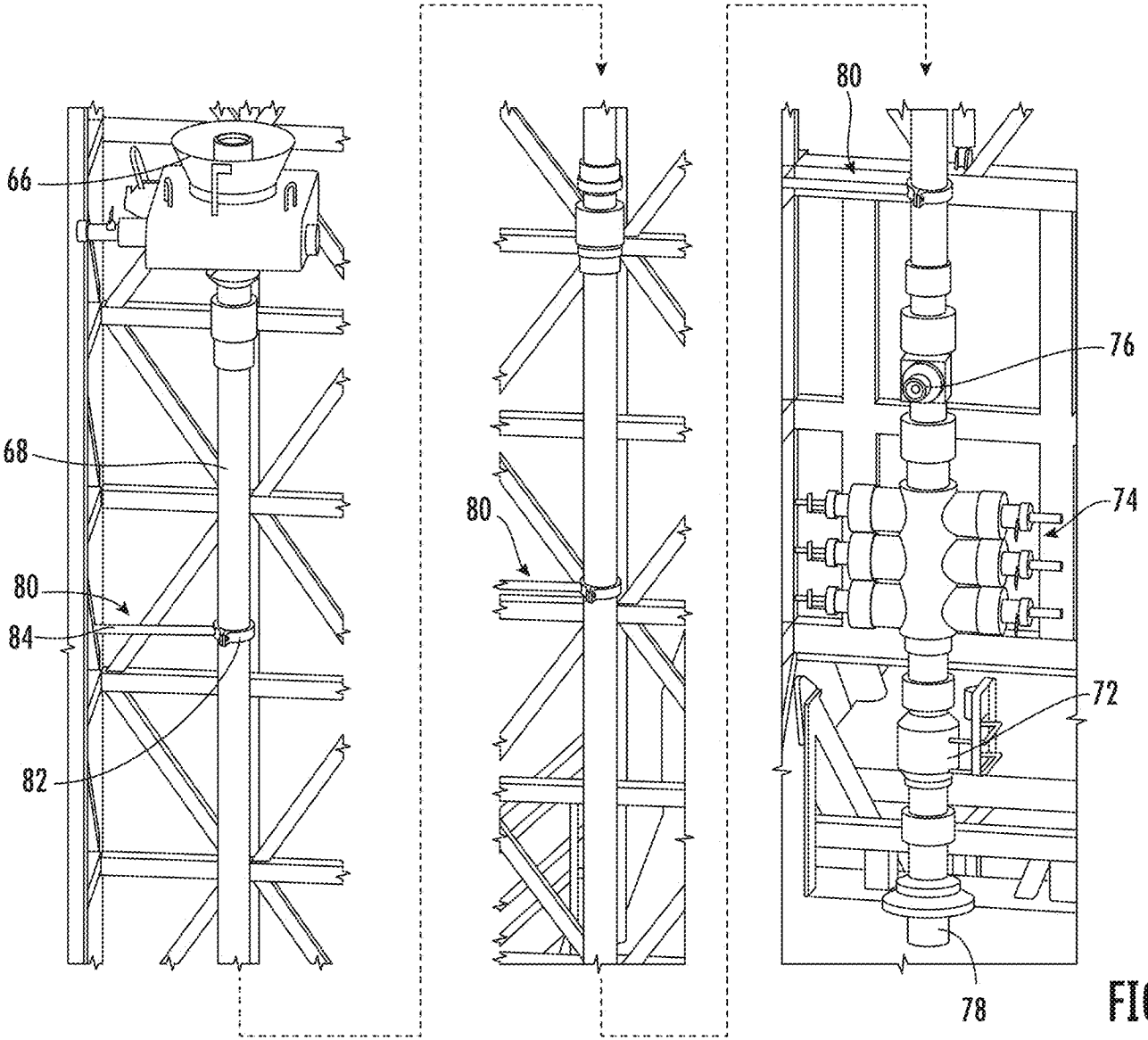
FIG. 6 is an exploded view of the lower section of the wireline derrick of FIG. 1.
Figure 7:
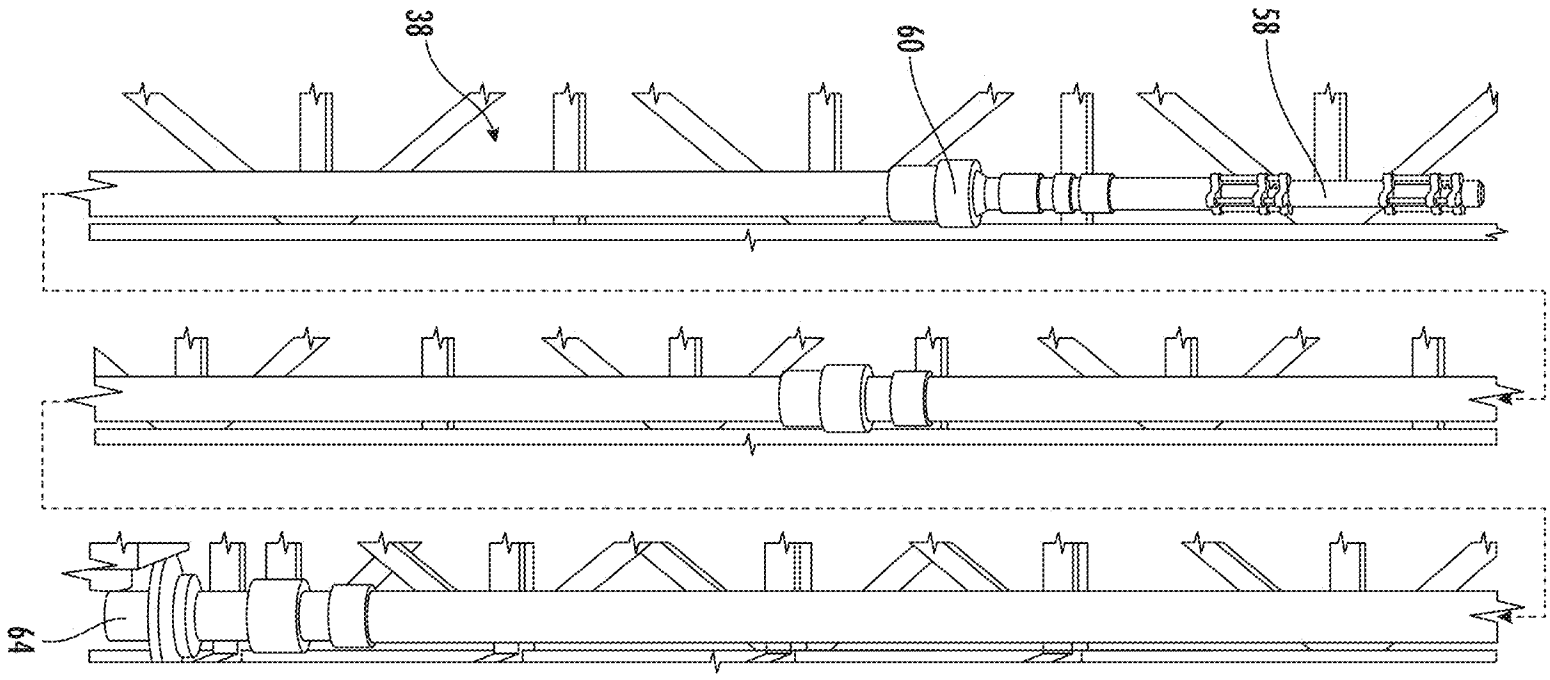
FIG. 7 is an exploded view of the upper section of the wireline derrick of FIG. 1.

Although the components of the lower and upper PCE assemblies 36, 38 can vary, referring to FIGS. 6 and 7, in preferred embodiments, the upper PCE assembly 38 comprises a greaseless pack-off or grease head 58, a lubricator cross over 60, an upper lubricator 62, and an HLA insertion portion 64. In preferred embodiments, the lower PCE assembly 36 may comprises a hydraulic lock assembly (HLA) receiver portion 66, (female portion), a lower lubricator 68, a tool trap 76, a blowout preventor (BOP) 74, a pump-in-sub 72, and an HLA insertion portion 78 (male portion). However, though not shown in detail in the figures, the PCE string 34 may comprise many other components and sub-assemblies (subs) known in the art, including, but not limited to one or more of the following: stuffing box; side door stripper; head catcher; bleed off valve; tandem stripper; riser; quick connect sub; cable cutter sub; hydraulic tool catcher; crossover; chemical injection sub; quick test sub; hydraulic tool trap; flanges; etc.

As best shown in FIG. 6, the lower PCE assembly 36 of the PCE string 34 is positioned within the lower cavity 32L and attached to the lower section 14 with a plurality of conventional and commercially available clamping assemblies 80. In preferred embodiments, the clamping assemblies comprise a lower PCE pipe clamp 82 and lower PCE extension arm 84, the lower PCE extension arm 84 being attached to both the lower PCE pipe clamp 82 and a portion of the lower section 14. With this configuration, the lower PCE assembly 36 is secured in the same fixed position relative to the lower section 14 when the wireline derrick 12 is in both the transport position shown, for example, in FIG. 9, or in the upright, partially deployed, or fully deployed position shown in FIGS. 1 and 9. The preferred fixed position of the lower PCE assembly 36 is such that the lower PCE assembly 36 is approximately centered within the lower section 14 and axially aligned with the sheave 45 of the upper section 16.

Figure 8:
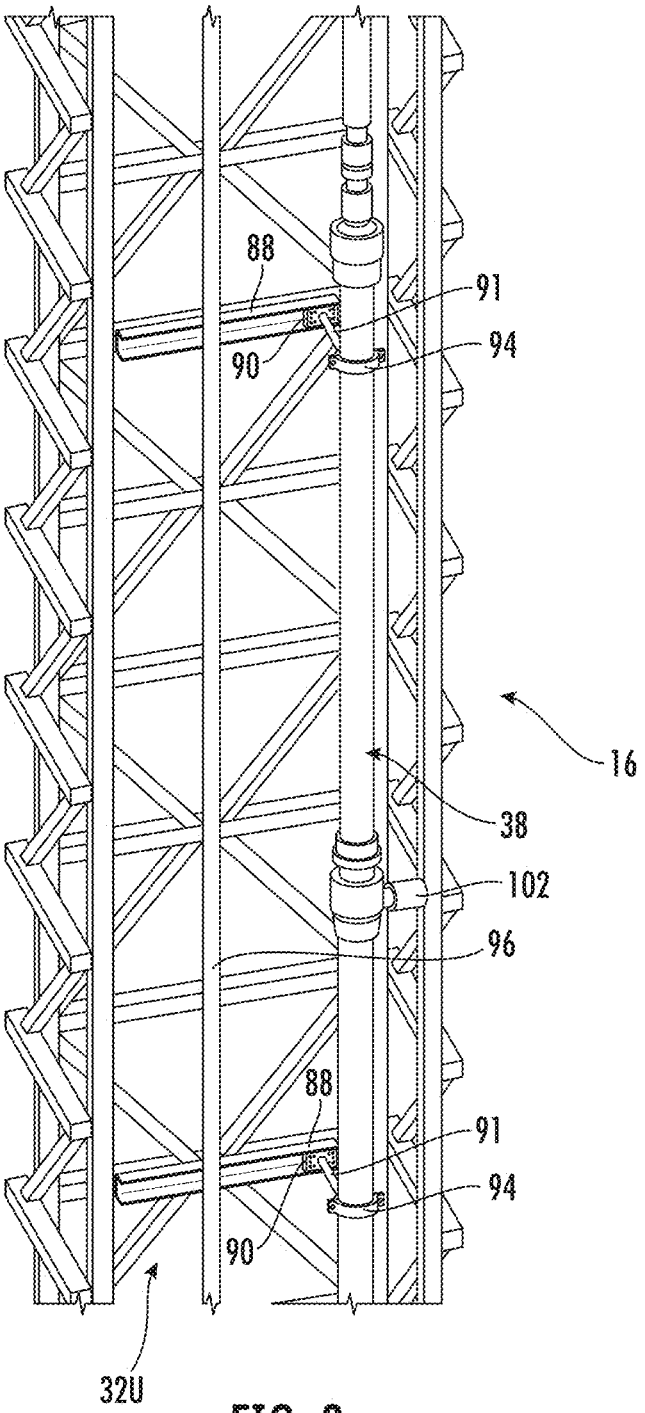
FIG. 8 is a partial view of the upper section of the wireline derrick of FIGS. 1 and 7.

As best shown in FIG. 8, the upper PCE assembly 38 of the PCE string 34 is movable, via one or more rail assemblies 86, from a transport position to an axially aligned position (FIG. 9). In the transport position, the upper PCE assembly 38 is positioned off-center relative to the upper section 16. Thus, in such transport position, the upper PCE assembly 38 does not interfere with or otherwise come in contact with the lower PCE assembly 36. This arrangement permits the upper and lower PCE assemblies 36, 38 to be positioned side by side when the upper section 16 has not been extended from the lower section 14, such as when, for example, the wireline derrick 12 is in the horizontal position, transport position (FIG. 9).

When the upper PCE assembly 38 is in the axially aligned position, the upper PCE assembly 38 is axially aligned with the lower PCE assembly 36, as shown, for example in FIG. 9. From the axially aligned position, the upper PCE assembly 38 can be lowered and coupled to the lower PCE assembly 36. In preferred embodiments, after being positioned in the axially aligned position, the upper PCE assembly 38 is lowered by lowering the upper section 16 as described herein. When the upper PCE assembly 38 is coupled to the lower PCE assembly 36, and the upper and lower sections 14, 16 are secured in position as described herein, the wireline derrick 12 is in the fully deployed position.

The rail assemblies 86 of preferred embodiments comprise a rail 88, a roller 90, an upper PCE extension arm 92, and an upper PCE pipe clamp 94. The rail 88 of preferred embodiments comprises a linear channel 98 within which the roller 90 can travel. The roller 90 is coupled to a first end of the upper PCE extension arm 92 in a conventional manner so as to permit lateral movement of the upper PCE extension arm 92. A second end of the upper PCE extension arm 92 is coupled to the upper PCE pipe clamp 94, which, in turn, is coupled to a portion of the upper PCE assembly 38. With this arrangement, the upper PCE assembly 38 can be moved from and between the transport position and the axially aligned position.

In preferred embodiments, the upper PCE assembly 38 comprises one or more conventional and commercially available hydraulic cylinders 96. The hydraulic cylinders 96 are operatively connected to a conventional hydraulic fluid supply and pump 218 adapted to permit selective movement of the hydraulic cylinders 96 from and between an extended position to a retracted position. Movement of the hydraulic cylinders 96 selectively moves the upper PCE assembly 38 from and between the transport position to the axially aligned position.

In preferred embodiments, the wireline derrick 12 comprises an electric wireline drum 37 mounted to the lower section 14. In preferred embodiments, the wireline derrick 12 comprises wireline cable 40 of <50,000 feet. In preferred embodiments, the wireline derrick 12 comprises a measuring head for depth and tension control with such information communicated to an operation control unit 214 which will be discussed in more detail below. In preferred embodiments, the wireline derrick 12 comprises a spooling control 101 that allows the wireline 40 to be spooled onto the drum 37 properly. In preferred embodiments, the wireline derrick 12 comprises wireline inspection equipment that allows OD inspection of the wireline 40 in real-time during operations. In preferred embodiments, the wireline derrick 12 comprises an automated oiling system that oils the wireline. In preferred embodiments, the wireline derrick 12 comprises a methanol system for the wireline.

In preferred embodiments, the wireline derrick 12 comprises automated processes related to: a BOP open/close process; a tool trap open/close process; auto-adjustment of the wireline 40 as the wireline derrick 12 extends or retracts; a quick test for the upper HLA 64, 66 after coupling; a pressure/time recording for the HLA 64, 66 quick test; etc.

In preferred embodiments, the wireline derrick 12 is adapted to be enclosed for winter time operations. This arrangement prevents surface equipment and the wellbore 132 from freezing up.

B. Transport Trailer

Referring to FIGS. 1, 9, 11-13, the wireline derrick 12 of preferred embodiments is transported to and from the wellsite 146 on the specially configured transport trailer 100. In addition to being adapted to transport the wireline derrick 12 to and from the wellsite 146, the transport trailer 100 is also structured and arranged to move the wireline derrick 12 from the transport position shown in FIG. 9 to an upright position shown in FIG. 9. Similarly, the transport trailer 100 is also structured and arranged to move the wireline derrick 12 from the upright position to the transport position.

Figure 12:
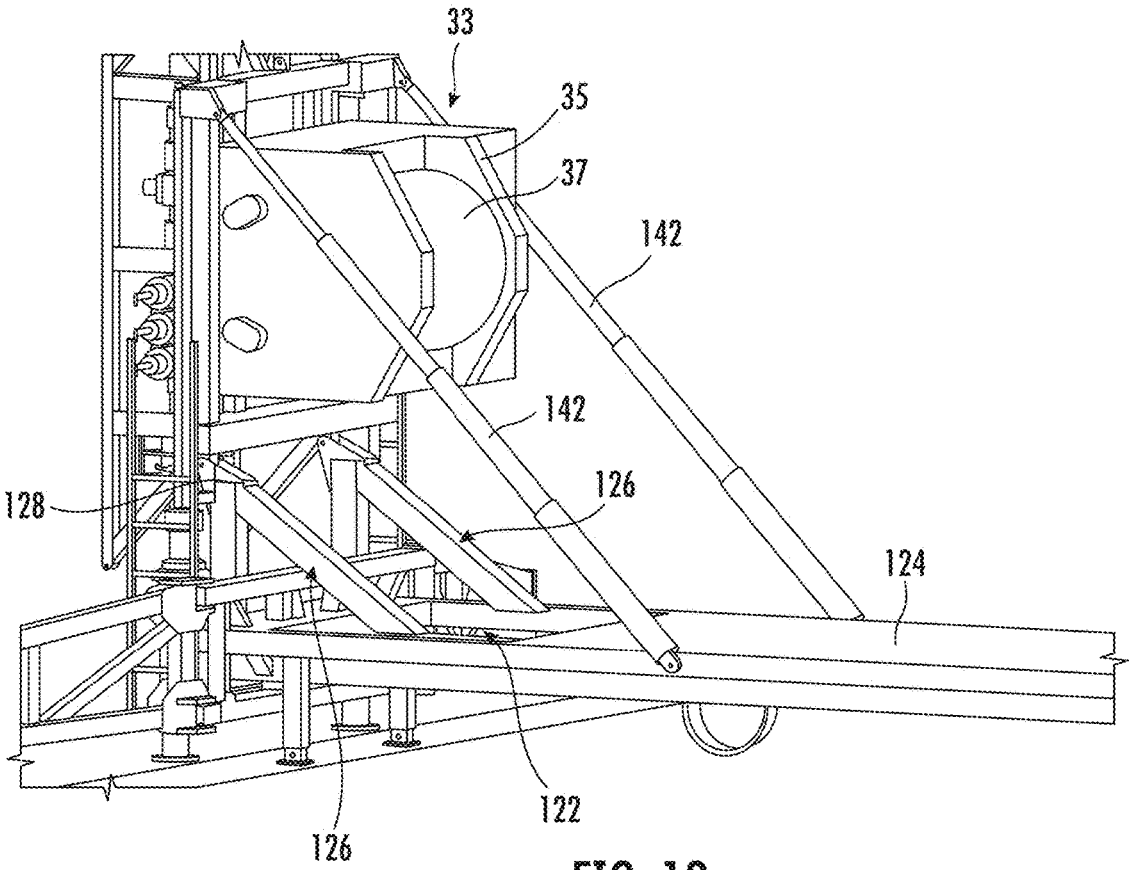
FIG. 12 is an enlarged rear view of the lower portion of the wireline derrick of FIGS. 1 and 11.

The transport trailer 100 is a gooseneck style trailer 100 having a deck 124, axle and wheel assemblies 125 and other conventional parts, components, and systems that permit the transport trailer 100 to be easily transported to and from the wellsite 146 by a suitable towing vehicle 104. In some embodiments, the transport trailer 100 comprises selectively deployable and retractable stabilizers 106, 108 such as outriggers 106 and/or jack stabilizers 108. As best shown in FIGS. 1 and 12, in a preferred embodiment, there are two outriggers 106, 106 and two jack stabilizers 108, 108 positioned proximate to a rearmost portion of the transport trailer 100. The outriggers 106, 106 and jack stabilizers 108, 108 are coupled to a stabilizing frame 110 portion of the transport trailer 100. Each of the outriggers 106, 106 is pivotally coupled to the stabilizing frame 110 such that the each can pivot towards and away from respective sides 112 of the transport trailer 100. When the wireline derrick 12 is being transported, a distal end of each of the outriggers 106, 106 is positioned proximate to the respective transport trailer sides 112. When the wireline derrick 12 is being erected, the distal end of each of the outriggers 106, 106 is positioned away from the respective transport trailer sides 112, as shown, for example, in FIGS. 1 and 11. In this position, respective outrigger foot pads 116 extend downward from the outrigger distal end so as to contact and rest on the surface 144 on which the transport trailer 100 is stabilized. In other embodiments, there are four outriggers 106, that, when deployed serve to stabilize the transport trailer 100 during use. In such embodiments, there are two outriggers 106 proximate to a front of the transport trailer 100 and two at the back.

Referring to FIG. 11, the jack stabilizers 108, 108 are positioned at rear outer corners of the stabilizing frame 110 such that each respective jack stabilizer 108 is positioned approximately even with the respective transport trailer sides 112. The jack stabilizers 108, 108 are vertically and axially positioned within respective tube portions 114 of the stabilizing frame 110. With this configuration, the respective jack stabilizers 108, 108 are structured to extend from and retract into the respective tube portions 114. When the wireline derrick 12 is being transported, a distal end of each of the respective jack stabilizers 108, 108 is retracted upward within the respective tube portions 114. When the wireline derrick 12 is being erected, the distal end of each of the respective jack stabilizers 108, 108 is extended downward so as to contact and rest on the surface 144 on which the transport trailer 100 is stabilized.

The stabilizers 106, 108 may part of a commercially available auto-leveling system 164. In addition to the stabilizers 106, 108, the auto-leveling system 164 comprises sensors, software, programming, and other elements adapted to deploy and retract the stabilizers 106, 108 and maintain the transport trailer 100 in a desired, preferably, level, position. In preferred embodiments, the stabilizers 106, 108 are hydraulically activated and powered. However, the stabilizers 106, 108 may be activated by other means, such as, for example, electric or pneumatic systems, and the like, or manually. Other stabilizing components and assemblies well known in the art may also be used to stabilize the transport trailer 100.

In preferred embodiments, the transport trailer 100 comprises two forward entry points, 119, 119. In such embodiments, the forward entry points, 119, 119 comprise steps, as shown in FIG. 1. In some embodiments, the transport trailer 100 comprises a cradle 120 on which the wireline derrick 12 rests and is secured to when being transported.

Referring to FIGS. 9, 11, and 12, in preferred embodiments, the transport trailer 100 comprises a recess 122 or through opening in the deck 124 structured to receive a portion of the casing 35 and wireline drum 37 and to permit the casing 35 and wireline drum 37 to countersink with the deck 124. Thus, when the wireline derrick 12 is being transported, a portion of the casing 35 and wireline drum 37 extend below the deck 124, as shown in FIG. 9.

Figure 13:
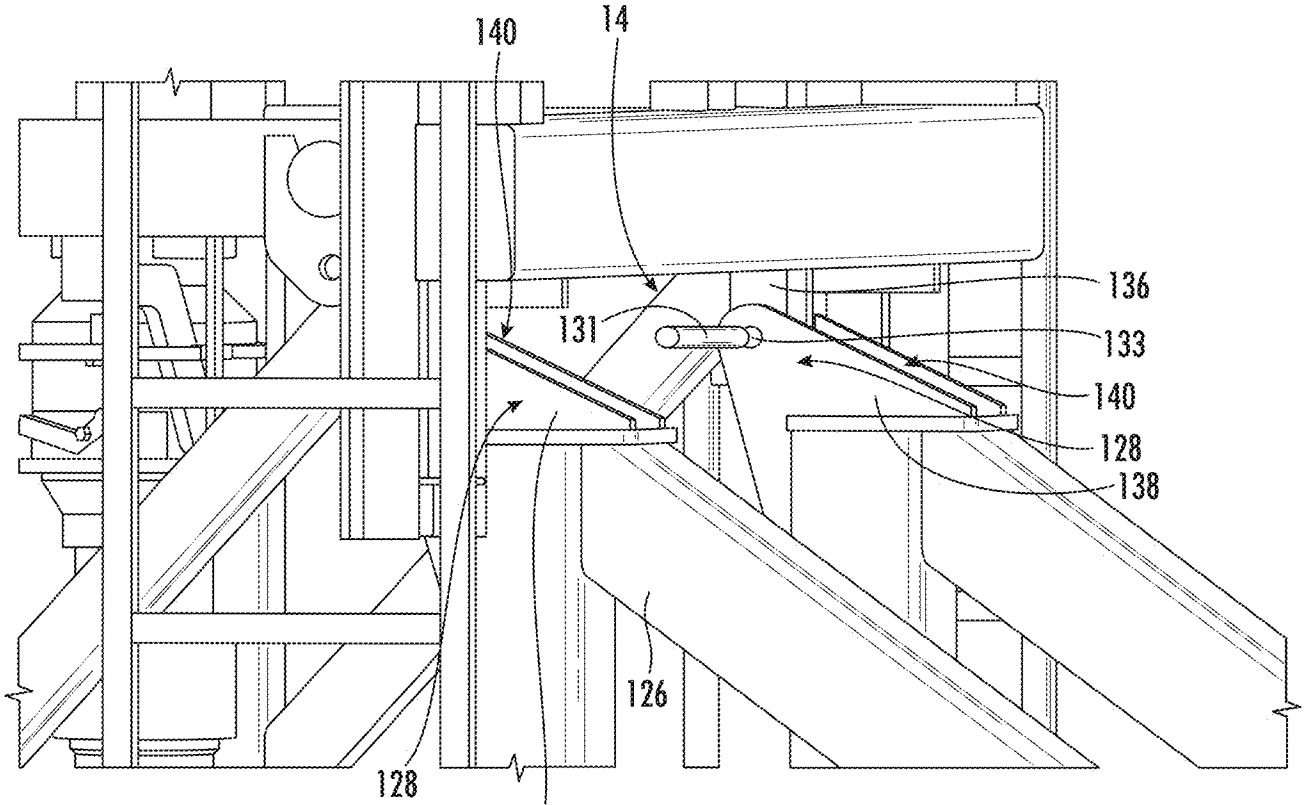
FIG. 13 is an additional enlarged rear view of the lower portion of the wireline derrick of FIGS. 1 and 11, and 12.

As best seen in FIGS. 12, and 13, extending upward from a rear of the deck 124 are support assemblies 126, 126. The support assemblies 126, 126 are pivotally and removably coupled with the lower section 14 via respective support receivers 128, 128 which are each adapted to receive respective lower section insertion members 136, 136. The support receivers 128, 128 each comprise a pair of upwardly projecting parallel plates 138, 138 separated by a respective space 140, 140. The respective spaces 140, 140 are adapted to receive the respective lower section insertion members 136, 136. Each pair of upwardly projecting parallel plates 138, 138 and respective lower section insertion members 136, 136 comprise a through opening 133 through which a pin 131 can be inserted in a manner well known in the art. This coupling arrangement between the parallel plates 138, 138 and the respective lower section insertion members 136, 136 permits the wireline derrick 12 to pivot, using the pin 131 as a fulcrum/pivot point, so that the wireline derrick 12 can be moved from the transport position to the upright position as depicted in FIG. 9.

As best shown in FIGS. 1 and 9, in preferred embodiments, the wireline derrick 12 is moved from the transport position to the upright position using respective transport trailer hydraulic cylinders 142, 142. In preferred embodiment, the transport trailer hydraulic cylinders 142, 142 are conventional and commercially available. Each of the transport trailer hydraulic cylinders 142, 142 is operatively connected to a hydraulic fluid and pump adapted to selectively move the transport trailer hydraulic cylinders 142, 142 from and between an extended position in which the wireline derrick 12 is in the upright position, to a retracted position in which the wireline derrick 12 is in the transport position. As will be discussed in more detail below, the transport trailer hydraulic cylinders 142, 142 are operatively connected to a hydraulic powerpack unit 218 (HPU 218) in an operation control unit 214. However, the transport trailer hydraulic cylinders 142, 142 can also be operationally connected to hydraulic fluid and a pump position on the transport trailer 100 or elsewhere.

In preferred embodiments, prior to rotating the wireline derrick 12 a properly sized crane 49 is connected to the wireline derrick 12 to follow the wireline derrick 12 as it is moved between various positions. This arrangement creates added safety to the operation. In preferred embodiments, the upper section 16 is extended from the lower section while attached to the transport trailer 100. Once in the upright position, the lower and upper sections 14, 16 are arranged and secured in the manner described herein such that the upper PCE assembly 38 is shifted into axial alignment with the lower PCE assembly 36 and the two PCE assemblies 36, 38 are coupled together. After the two PCE assemblies 36, 38 are secured and the pins 131 are removed from the respective through openings 133 in the support receivers 128, 128 and lower section insertion members 136, 136, the crane 49 can remove the wireline derrick 12 from the transport trailer 100. After removing the wireline derrick 12 from the transport trailer 100, the crane 49 can then move the wireline derrick 12 to a desired position, such as at the wellhead 130 or near the operation control unit 214.

C. Operation Control Unit

Figure 10:
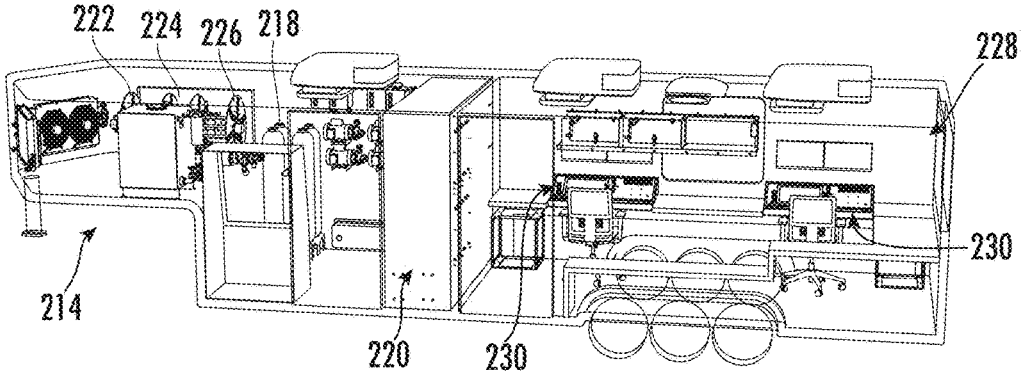
FIG. 10 is a side cutaway isometric view of the operation control unit, in accordance with a preferred embodiment.
Figure 14:
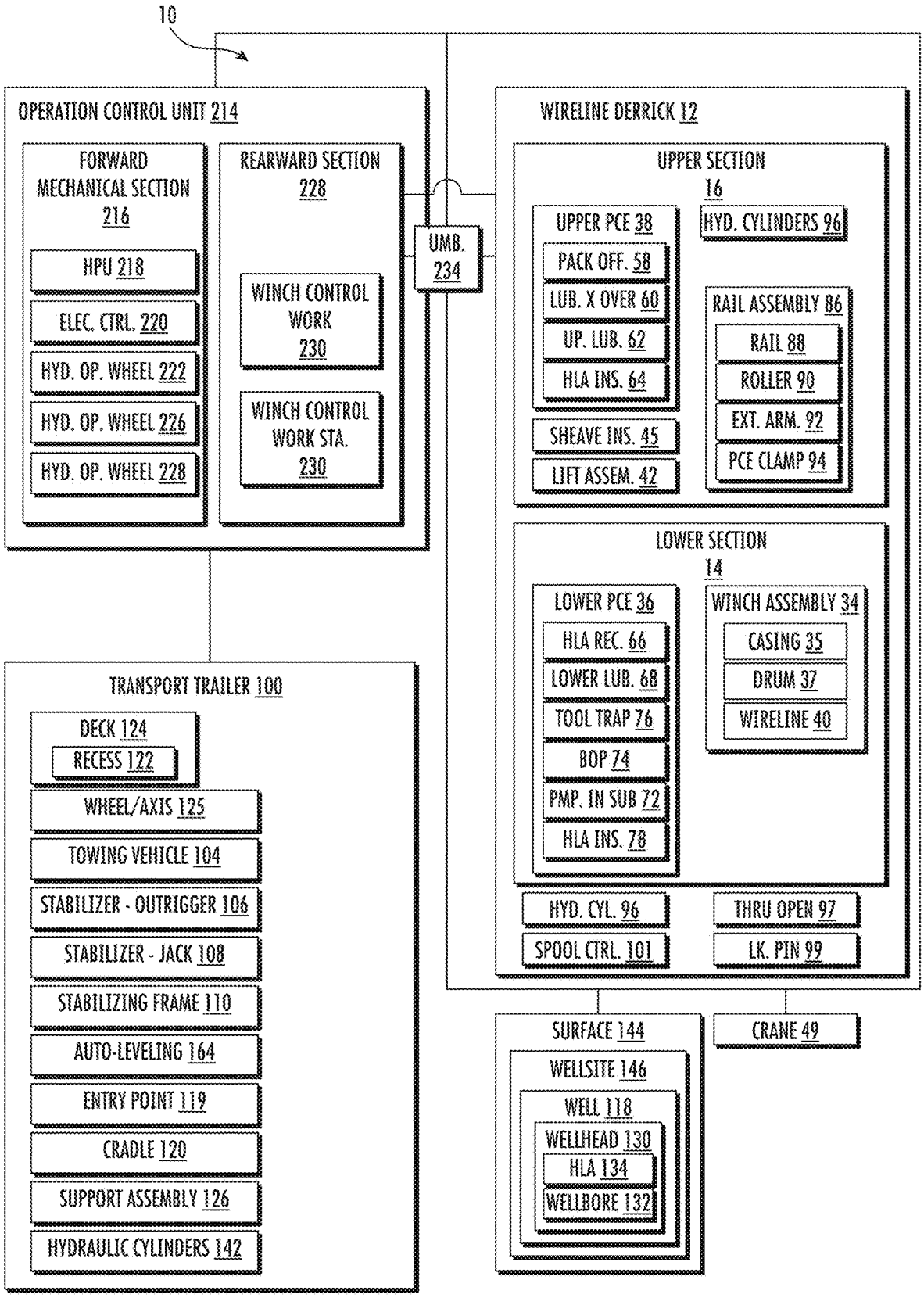
FIG. 14 is a block diagram showing various components of the system of preferred embodiments.

The system 10 of preferred embodiments is structured and arranged such that substantially all the wireline components described herein are operated and controlled in the operation control unit 214. Referring to FIGS. 10, 13, and 14, the operation control unit 214 comprises a climate controlled forward mechanical section 216 and rearward section 228. The forward mechanical section 216 comprises the HPU 218, electric controls 220, and a plurality of hydraulic operated reels 222, 224, 226. The HPU 218 is a hydraulic power unit used to control all hydraulic functions for two wireline derricks 12, 12. Similarly, the electric controls 220 are used to control all electrical functions for two wireline derricks 12, 12. A first hydraulic operated reel 222 is structured to be used to control the transport trailer 100 functions discussed herein, including, but not limited to moving the wireline derrick 12 from and between the extended and retracted positions, extending and retracting the upper section 16 from/into the lower section 14. A second hydraulic operated reel 224 is structured to be used to control PCE string 34 functions, including, but not limited to operating the HLA's 64, 66, the BOP 74, the tool trap 76, and the pack-off 58. A third hydraulic operated reel 226 is structured to be used to control an umbilical cord 234 to each structure that permits an operator to communicate with the wireline 40 during wireline operations.

The rearward section 228 of the preferred embodiment comprises dual winch control work stations 230, 230. This arrangements permits two operators to simultaneously control winch operations of two wireline derricks 12. The operation control unit 214 is further structured and adapted to permit operators to monitor and control various operation parameters. For example, the operation control unit 214 is communicatively and operationally linked to inspection equipment for monitoring wireline 40 OD during operations; view the wireline derrick 12 using cameras and LED lighting connected to or adjacent to the wireline derrick 12.

Many automated functions can be monitored and controlled from the operation control unit 214. For example, operators can monitor and/or control: a BOP open/close process; a tool trap open/close process; auto-adjustment of the wireline 40 as the wireline derrick 12 extends or retracts; a quick test for the upper HLA 64, 66 after coupling; a pressure/time recording for the HLA 64, 66 quick test; etc.

Communication to and from the wireline derrick 12 can be initiated, monitored, and controlled from the operation control unit 214. Each wireline derrick 12 receives directions and communication from the operation control unit 214. Electric power for and to the wireline drum 37 is controlled and directed from the operation control unit 214. The operation control unit 214 is structured and set up to control and host communications between the various systems and subsystems used in wireline operations, including, but not limited to those related to depth & tension monitoring; communication with the BHA; hydraulic power for pressure control; operation of the BOP's, tool trap, HLA's, pack-off pressure, cameras and sensors; measuring head and BHA weight with indicator attached to drum; slip ring communication off drum; and wireline oiling system.

Referring to FIG. 10, the operation control unit 214 of preferred embodiments is a mobile structure adapted to be transported to the wellsite 146 by a suitable towing vehicle 104. Although, in the preferred embodiments, the operation control unit 214 is referred to as a "mobile" structure 214. The operation control unit 214 need not be mobile. In other embodiments, the operation control unit 214 is a permanent structure. However, preferably, the operation control unit 214 comprises a wheeled chassis 232 or is readily mountable on a trailer. The operation control unit 214 of preferred embodiments comprises a gooseneck style arrangement having axle and wheel assemblies and other conventional parts that permit the operation control unit 214 to be easily transported to and from the wellsite 146.

D. Wireline System

Referring to FIG. 14, also provided and disclosed herein is a wireline system 10. The wireline system of preferred embodiments comprises the wireline derrick 12, the transport trailer 100, and the operation control unit 214. The wireline derrick 12 of the wireline system 10 of preferred embodiments comprises any of the features discussed herein. The transport trailer 100 comprises any of the features discussed herein with respect to the transport trailer 100. The operation control unit 214 of preferred embodiments comprises any of the features discussed herein related to the operation control unit 214.

The features of the wireline derrick 12, the transport trailer 100, and the operation control unit 214 of the wireline system 10 are set forth above and incorporated herein by reference. Thus, such features of the various systems, subsystems, assemblies, and individual components of the wireline derrick 12, the transport trailer 100, and the operation control unit 214 will not be repeated here.

E. Wireline Derrick Deployment and Disengagement Process

Also provided and disclosed herein is a process for deploying a wireline derrick 12. The process of preferred embodiments comprises the steps of:

1.) providing a wireline derrick 12, the wireline derrick 12 comprising: (a) a telescopically arranged lower section 14 and upper section 16; (b) a winch 33 assembly; (c) a pressure control equipment string 34 (PCE string 34) comprising a lower PCE assembly 36 and an upper PCE assembly 38;
2.) providing a transport trailer 100;
3.) Using the transport trailer 100, moving the wireline derrick 12 from a transport position to an upright position;
4.) Using the transport trailer 100, extending the upper section 16 from the lower section 14;
5.) Moving the upper PCE assembly 38 into axial alignment with the lower PCE assembly 36;
6.) Coupling the upper PCE assembly 38 with the lower PCE assembly 36;
7.) Securing the upper section 16 to the lower section 14.

In other embodiments of the process for assembling a wireline derrick 12, the wireline derrick 12 is moved by a crane 49 from a position proximate to the transport trailer 100 to a position away from the transport trailer 100.

In other embodiments of the process for deploying a wireline derrick 12, the position away from the transport trailer 100 is a wellhead 130.

In other embodiments of the process for assembling a wireline derrick 12, the position away from the transport trailer 100 is a position proximate to an operation control unit 214.

Also provided and disclosed herein is a process for removing from deployment (hereafter "disengaging") a wireline derrick 12. The process of preferred embodiments comprises the steps of:

2.) providing a wireline derrick 12 in a deployed condition, the wireline derrick 12 comprising: (a) a telescopically arranged lower section 14 and upper section 16; (b) a winch 33 assembly; (c) a pressure control equipment string 34 (PCE string 34) comprising a lower PCE assembly 36 and an upper PCE assembly 38; the lower section 14 being secured to the upper section 16; the lower PCE assembly 36 being coupled to the upper PCE assembly 38;
2.) providing a transport trailer 100;
3.) disengaging the upper section 16 from the lower section 14;
4.) decoupling the upper PCE assembly 38 from the lower PCE assembly 36;
5.) Moving the upper PCE assembly 38 out of axial alignment with the lower PCE assembly 36;
5.) Using the transport trailer 100, retracting the upper section 16 into the lower section 14;
6.) Using the transport trailer 100, moving the wireline derrick 12 from an upright position to a transport position on the transport trailer 100.

In other embodiments of the process for disengaging a wireline derrick 12, the wireline derrick 12 is moved by a crane 49 from a position away from the transport trailer 100 to a position proximate to the transport trailer 100.

In other embodiments of the processes for deploying a wireline derrick 12 and disengaging a wireline derrick 12, the features of the wireline derrick 12, and/or the transport trailer 100 are set forth above and incorporated herein by reference. Thus, such features of the various systems, subsystems, assemblies, and individual components of the wireline derrick 12 and the transport trailer 100 provided in the processes for deploying a wireline derrick 12 and disengaging a wireline derrick 12 will not be repeated here.

The wireline derrick 12, system 10, and process of the present disclosure can be deployed, used, and disengaged quickly, efficiently, and safely. The wireline derrick 12, system 10, and process eliminates space required at the wellsite 146 conventionally required. As discussed and described herein, the wireline derrick 12, system 10, and process eliminates:

the need to assemble the entire PCE string 34 on site 146;
the need for wireline trucks, wheel chalks for truck type units, wireline skids, anchors for skid type units;
the need for lower sheave wheels;
the need to run wireline 40 across the surface 144 of the wellsite 146 from the wellhead 130 to a wireline truck;
the need for personnel to hold the wireline 40 down to bump tools up;
the chance of crowning out the tool string, which can undesirably result in falling.

The detailed description provided herein illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention. Any dimensional ranges provided herein are provided as best embodiments and not limitations. Therefore, this disclosure is not limited by such dimensions. Other dimensions, shapes, configurations, etc. may be used that fall within the scope and spirit of this disclosure and accompanying claims.

I claim:

1. A wireline derrick, comprising:

an elongated frame and a pressure control equipment string;

the elongated frame being moveable from a horizontal position to an upright position;

the elongated frame comprising first and second ends such that, when the elongated frame is in the upright position, the first end is an upper end and the second end is a lower end;

the upper end being adapted to be coupled to a sheave adapted to receive a wireline;

the pressure control equipment string comprising pressure control equipment;

the elongated frame comprising a longitudinal cavity, the pressure control equipment string being longitudinally positioned within the longitudinal cavity and secured to the elongated frame both in the horizontal position and in the upright position, such that, when the elongated frame is in the upright position, the pressure control equipment string is positioned below the upper end;

the wireline derrick being structured and arranged to be lifted by a crane and moved to a position proximate to a wellhead such that the pressure control equipment string positioned within the longitudinal cavity is in axial alignment with the wellhead.

2. The wireline derrick of claim 1, wherein:

the elongated frame comprises an upper section and a lower section;

the upper section and lower section being telescopically arranged such that, relative to the lower section, the upper section can be extended and retracted.

3. The wireline derrick of claim 2, the pressure control equipment string comprising an upper PCE assembly and a lower PCE assembly.

4. The wireline derrick of claim 3, wherein a lower end of the upper PCE assembly is adapted to be removably coupled to an upper end of the lower PCE assembly.

5. The wireline derrick of claim 4, wherein the upper PCE assembly is secured to the elongated frame upper section and the lower PCE is secured to the elongated frame lower section.

6. The wireline derrick of claim 5, wherein, when the wireline derrick is in a retracted position, the upper PCE assembly is positioned adjacent to the lower PCE assembly.

7. The wireline derrick of claim 6, the upper PCE assembly being laterally moveable, such that when the wireline derrick is in an extended position, the upper PCE assembly may be moved into and out of axial alignment with the lower PCE assembly.

8. The wireline derrick of claim 7, wherein, when in a fully deployed condition, the lower end of the upper PCE assembly is removably coupled to the upper end of the lower PCE assembly.

9. The wireline derrick of claim 8, further comprising a winch.

10. A wireline derrick system, the system comprising:

a wireline derrick, and a transport trailer;

the wireline derrick comprising:

an elongated frame and a pressure control equipment string;

the elongated frame being moveable from a horizontal position to an upright position;

the elongated frame, when in the upright position, comprising upper and lower ends;

the upper end being adapted to be coupled to a sheave adapted to receive a wireline;

the pressure control equipment string comprising pressure control equipment;

the elongated frame comprising a longitudinal cavity, the pressure control equipment string being longitudinally positioned within the longitudinal cavity and secured to the elongated frame both in the horizontal position and in the upright position, such that, when the elongated frame is in the upright position, the pressure control equipment string is positioned below the upper end;

the transport trailer comprising:

a deck and a support member, the support member being adapted to be removably and pivotally coupled to the wireline derrick;

one or more hydraulic cylinders adapted to move the wireline derrick from the horizontal position to the upright position;

the wireline derrick being structured and arranged to be removed from the transport trailer and moved to a position proximate to a wellhead such that the pressure control equipment string positioned within the longitudinal cavity is in axial alignment with the wellhead.

11. The wireline derrick system of claim 10, wherein:

the elongated frame comprises an upper section and a lower section;

the upper section and lower section being telescopically arranged such that, relative to the lower section, the upper section can be extended and retracted.

12. The wireline derrick system of claim 11, the pressure control equipment string comprising an upper PCE assembly and a lower PCE assembly.

13. The wireline derrick system of claim 12, wherein a lower end of the upper PCE assembly is adapted to be removably coupled to an upper end of the lower PCE assembly.

14. The wireline derrick system of claim 13, wherein the upper PCE assembly is secured to the elongated frame upper section and the lower PCE is secured to the elongated frame lower section.

15. The wireline derrick system of claim 14, wherein, when the wireline derrick is in a retracted position, the upper PCE assembly is positioned adjacent to the lower PCE assembly.

16. The wireline derrick system of claim 15, the upper PCE assembly being laterally moveable, such that when the wireline derrick is in an extended position, the upper PCE assembly may be moved into and out of axial alignment with the lower PCE assembly.

17. The wireline derrick of claim 16, wherein, when in a fully deployed condition, the lower end of the upper PCE assembly is removably coupled to the upper end of the lower PCE assembly.

18. The wireline derrick system of claim 17, further comprising a winch.

19. A wireline derrick deployment process, the process comprising the steps of:

providing a wireline derrick and a crane, the wireline derrick comprising:

(a) an elongated frame comprising a telescopically arranged lower section and upper section;

(b) a winch assembly;

(c) a pressure control equipment string comprising a lower PCE assembly and an upper PCE assembly, the pressure control equipment string being longitudinally positioned within a longitudinal cavity of the elongated frame and secured to the elongated frame both in a horizontal transport position and an upright position;

providing a transport trailer;

using the transport trailer, moving the wireline derrick from the horizontal transport position to the upright position;

extending the upper section from the lower section;

moving the upper PCE assembly into axial alignment with the lower PCE assembly;

coupling the upper PCE assembly with the lower PCE assembly;

securing the upper section to the lower section;

using the crane, removing the wireline derrick from the transport trailer and moving the wireline derrick to a position proximate to a wellhead such that the pressure control equipment string positioned within the longitudinal cavity is in axial alignment with the wellhead.

20. A wireline disengagement process, the process comprising the steps of:

providing a wireline derrick, a transport trailer, and a crane;

the wireline derrick being in a deployed condition and at a position away from the transport trailer, the wireline derrick comprising:

(a) a telescopically arranged elongated frame comprising a lower section and an upper section;

(b) a winch assembly;

(c) a pressure control equipment string comprising a lower PCE assembly and an upper PCE assembly, the lower PCE assembly and upper PCE assembly being secured to the elongated frame;

the lower section being secured to the upper section;

the lower PCE assembly being coupled to the upper PCE assembly;

disengaging the upper section from the lower section;

decoupling the upper PCE assembly from the lower PCE assembly;

moving the upper PCE assembly out of axial alignment with the lower PCE assembly;

using the crane, and with the lower PCE assembly and upper PCE assembly secured to the elongated frame, moving the wireline derrick to a position proximate to the transport trailer;

retracting the upper section into the lower section;

using the transport trailer, and with the lower PCE assembly and upper PCE assembly secured to the elongated frame, moving the wireline derrick from an upright position to a transport position on the transport trailer.

* * * * *